US006663019B2

(12) United States Patent
Garcia et al.

(10) Patent No.: US 6,663,019 B2
(45) **Date of Patent: *Dec. 16, 2003**

(54) SAMPLING-TYPE SPRAYING DEVICE

(75) Inventors: Firmin Garcia, Evreux (FR); Aline Abergel, Boulogne-Billancourt (FR)

(73) Assignee: Valois S.A., Le Neubourg (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/245,117

(22) Filed: Sep. 17, 2002

(65) Prior Publication Data

US 2003/0015605 A1 Jan. 23, 2003

Related U.S. Application Data

(63) Continuation of application No. 09/700,642, filed as application No. PCT/FR99/01164 on May 17, 1999, now Pat. No. 6,460,781.

(51) Int. Cl.[7] ..... B65D 1/32

(52) U.S. Cl. ..... 239/327; 239/326; 239/309; 239/323; 239/328; 239/329; 239/330; 222/630; 222/631; 222/632; 222/633

(58) Field of Search ..... 239/302, 309, 239/327, 328; 222/95, 107, 202, 203, 630, 631, 632, 633

(56) References Cited

U.S. PATENT DOCUMENTS

| | | | | | |
|---|---|---|---|---|---|
| 630,277 | A | * | 8/1899 | Weitling | 239/327 |
| 1,490,496 | A | * | 4/1924 | Trevillian | 239/327 X |
| 2,699,888 | A | * | 1/1955 | Crane | 222/633 |
| 2,707,581 | A | * | 5/1955 | Kaplan et al. | 222/107 |
| 2,786,717 | A | * | 3/1957 | Rausch | 239/327 |
| 3,184,121 | A | * | 5/1965 | Volckening | 222/107 |
| 3,897,005 | A | * | 7/1975 | Reiner | 239/327 |
| 3,913,789 | A | * | 10/1975 | Miller | 222/107 |
| 4,162,748 | A | * | 7/1979 | Bennett | 239/327 X |
| 4,335,815 | A | | 6/1982 | Babiol et al. | |
| 4,787,536 | A | | 11/1988 | Widerstrom | |
| 4,858,831 | A | * | 8/1989 | Spector | 239/326 |
| 4,869,407 | A | * | 9/1989 | Booth, Jr. et al. | 239/326 X |
| 4,921,137 | A | * | 5/1990 | Heijenga | 222/107 |
| 4,988,016 | A | * | 1/1991 | Hawkins et al. | 222/92 |
| 5,111,932 | A | * | 5/1992 | Campbell | 206/216 |
| 5,115,221 | A | | 5/1992 | Cowman | |
| 5,215,221 | A | * | 6/1993 | Dirksing | 222/94 |
| 5,482,193 | A | | 1/1996 | Fuchs | |
| 5,529,224 | A | | 6/1996 | Chan et al. | |
| 5,582,330 | A | | 12/1996 | Iba | |
| 5,996,845 | A | * | 12/1999 | Chan | 222/107 |
| 6,460,781 | B1 | * | 10/2002 | Garcia et al. | 239/327 |
| 6,540,079 | B1 | * | 4/2003 | Garcia et al. | 222/107 |
| 2003/0010844 | A1 | * | 1/2003 | Duqueroie | 239/327 |

FOREIGN PATENT DOCUMENTS

| | | |
|---|---|---|
| EP | 0 761 314 A2 | 11/1992 |
| FR | 2 232 923 | 6/1973 |
| WO | WO 97/29020 | 8/1997 |

* cited by examiner

*Primary Examiner*—Robin O. Evans
(74) *Attorney, Agent, or Firm*—Wood, Phillips, Katz, Clark & Mortimer

(57) ABSTRACT

A dispenser device is provided for dispensing a fluid substance in spray form. The dispenser device comprising a reservoir containing the fluid to be dispensed and a spray orifice. The reservoir includes at least one actuating wall that can be deformed by applying a pressing force.

10 Claims, 3 Drawing Sheets

SAMPLING-TYPE SPRAYING DEVICE

CROSS REFERENCE TO RELATED APPLICATION

This application is a continuation of U.S. patent application Ser. No. 09/700,642 filed Mar. 22, 2001 now U.S. Pat. No. 6,460,781 under 35 U.S.C. Sec. 371 and a national stage of international application PCT/FR99/01164,which was filed May 17, 1999.

TECHNICAL FIELD

The present invention relates to a dispenser device for dispensing a fluid substance in spray form. More particularly, the invention relates to a miniature spray device that is preferably disposable, and in particular suitable for spraying a sample in the pharmaceuticals, perfumery, or cosmetics fields.

BACKGROUND OF THE INVENTION

The problems encountered for such a substance dispenser are, in particular, the requirements of being inexpensive to manufacture. Since samples are not generally intended for sale, their manufacturing cost must be as low as possible. It is thus important to have dispensers whose parts are easy to make on a mass-produced basis and which are particularly simple to assemble. Furthermore, since samples serve mainly for advertising purposes, it is desirable for the dispenser to be capable of bearing, in visible manner, the trademark, the logo or any other distinctive feature corresponding to the substance contained in the dispenser. Similarly, it is desirable to provide a device that has a shape that is both original and practical to use. For example, for samples to be included between the pages of magazines or journals, it is essential for the thickness of the dispenser to be very small.

A dispenser device of the invention may also have uses in the pharmaceuticals field. In this particular field, it is important for the dose or metered quantity of substance to be accurate. Furthermore, it is also important for the spray to be of good quality.

For example, it is known from Document FR-A-2 443 980 that a disposable vaporizer can be made by welding together sheets of plastic so that, between them, they define a reservoir and two swirl channels connected to a spray orifice. By pressing on the reservoir whose walls are made of sheets of plastic, the substance is delivered into the swirl channels and then cut through the spray orifice to create a jet of sprayed substance. However, that disposable vaporizer does not make it possible to expel a defined metered quantity of substance. In addition, forming the swirl channels by welding two sheets of plastic together is rather imprecise and haphazard. In a version of that vaporizer, the reservoir is subdivided into two chambers by a partition which breaks under the applied pressure. One chamber is filled with a fluid while the other contains some other substance and air. Furthermore, the reservoir is separated from the spray orifice by a weak point. Firstly, on pressing the reservoir, the partition breaks, and the two fluids mix to some extent with each other and with air. In any event, the resulting mixture cannot be homogeneous. By increasing the applied pressure, the weak point breaks and the non-homogeneous mixture is delivered to the spray orifice. The jet that is output via the orifice is made up sometimes of a first fluid, sometimes of a second fluid, and sometimes of air, but it is never made up of a homogeneous mixture of all three. Therefore, the jet is sometimes purely aqueous, and sometimes two-phase. Its quality is thus not constant.

Document FR-2 232 923 describes a dispenser of the same type and suffering from similar problems.

Document WO 98/01360 discloses a two-phase dispenser capable of delivering a metered quantity of substance in spray form. That dispenser is also organized to serve as a miniature spray device in the form of a sample. It comprises two reservoirs of air and one reservoir of substance, all three reservoirs being connected to a common spray orifice. Upstream from the spray orifice, a fiber is provided that is capable of being soaked with substance. The air expelled from the reservoir of air therefore passes through the fiber soaked with substance expelled from the two reservoirs of substance. To actuate the device, a press member is provided in the form of a tab that can be folded down over the reservoirs to flatten them, thereby causing both substance and air to be delivered to the spray orifice. The various reservoirs are formed between a backing and a flexible barrier film. The press tab causes the film to be flattened against the backing where the film and the backing co-operate to form the reservoirs of substance and of air.

A drawback of that type of two-phase dispenser is that the quality of the spray depends on the speed at which the tab is actuated against the reservoirs. If the tab is brought slowly against the reservoirs, the spray is of poor quality. Therefore, it is necessary to press down the tab at some speed.

SUMMARY OF THE INVENTION

An object of the present invention is to solve that problem of the prior art by defining a low-cost dispenser device that guarantees excellent spray quality under all circumstances. In addition, in certain uses, in particular for advertising, the dispenser must satisfy certain dimensional requirements, in particular if it is to be of very low thickness so that it can be incorporated in a magazine or a journal. Furthermore, it should be capable of withstanding high pressures without substance leaking out. When such a sample is included in a magazine and, for example, the magazines are stacked up, the included sample is subjected to a high pressure.

To solve that problem, the present invention proposes a dispenser device for dispensing a fluid substance in spray form, said device comprising a reservoir containing the fluid substance to be dispensed, and a spray orifice, said reservoir including at least one actuating wall that can be deformed by applying a pressing force so as to reduce the internal volume of the reservoir and thus to exert a pressure on the fluid substance so as to deliver it through the spray orifice, said at least one actuating wall having a predetermined threshold of resistance to deformation that must be overcome in order to deform it.

In an embodiment, said at least one actuating wall has a convex profile at rest, which rest profile is suitable for deforming suddenly and easily into a determined concave profile, when the pressing force reaches said resistance threshold.

Like the devices described in the prior art, the device of the invention is also actuated by pressing on an actuating wall, but, in the present invention, the state of deformation of the wall(s) does not depend linearly on the pressing force, but rather it requires a predetermined threshold to be exceeded so that energy is accumulated in the finger of the user, which energy is released suddenly when the force exceeds said resistance threshold of the wall. In this way, a sort of pre-compression is obtained, although the liquid inside the reservoir is not subjected to any pressure so long as the wall is not deformed. The potential energy accumulated in the finger of the user ensures that, on release, there is sufficient energy to achieve good spraying of the substance. In dynamic manner, so long as the pressing force has not reached said threshold, the wall remains at rest. As soon as the force exceeds this threshold, the wall leaves its rest position, and while it is deforming to its final deformed position, the force required is, in fact, considerably lower than the pressing force required to overcome the resistance threshold. As a result, after leaving the rest position, deformation takes place quickly and suddenly because the force is much higher than necessary. The rest position thus constitutes a point of resistance after which the force necessary to deform the wall is considerably lower to reach the final deformed state.

In an embodiment, said at least one actuating wall has at least one reinforcing rib or groove for increasing its rigidity or defining its periphery. The point of resistance is then formed by the grooves or the ribs.

According to another characteristic, said at least one actuating wall has shape memory enabling it to return to its initial shape after the pressing force is released. It is thus guaranteed that the dispenser can be used a plurality of times without spoiling the actuating capacity of the wall.

In addition, it is advantageous for said at least one actuating wall to have a constant deformed state so that the quantity of product dispensed is constant and metered. A dispenser having predetermined resistance to deformation, shape memory, and constant deformed state guarantees that an accurate metered quantity of substance is sprayed repeatedly with optimum quality. When the dispenser is used for two-phase spraying, the use of one or two actuating wall(s) of the invention is particularly advantageous because the actuating wall does not act directly on the fluid substance, but rather it acts on the gas inside the reservoir by compressing it suddenly.

In an advantageous embodiment for two-phase use, an insert comprising a retaining piece of porous material suitable for becoming soaked with fluid substance is disposed upstream from the spray orifice. The porous retaining piece is automatically soaked with fluid substance by capillary action when the dispenser is at rest, and it then passes a flow of air which is put under pressure by actuating the wall of the reservoir.

According to another characteristic, the spray orifice is hermetically sealed off by a stopper member before the dispenser is used. Therefore, any actuating of the wall merely causes the air inside the reservoir to be compressed, without any spray being emitted. The stopper member thus serves as a safety member and as a guarantee that the dispenser has not yet been used for the first time.

In a practical embodiment, the dispenser device may be made up of a thermoformed shell forming the actuating wall and of a closure film, the shell and the film co-operating to define the reservoir and the spray orifice. The dispenser can thus be manufactured very simply and rapidly on a single assembly line.

In a variant, the dispenser may be made up of two thermoformed shells, each of which forms an actuating wall, the two shells being assembled together in sealed manner, so as to form the reservoir and the spray orifice between them.

BRIEF DESCRIPTION OF THE DRAWINGS

The invention is described more fully below with reference to the accompanying drawings which give an embodiment of the present invention by way of non-limiting example.

In the drawings.

DETAILED DESCRIPTION OF THE PREFERRED EMBODIMENTS

In the figures, the dispenser device of the invention that is shown is a sample of the "free sample" type serving to be incorporated into magazines or journals as advertising, e.g. for a perfume. It can thus be understood that the dispenser is relatively flat. Such use as a free sample should not be considered as being the sole use or as being limiting. The present invention is applicable to any fluid substance dispenser that has an actuating wall to be deformed in order to exert a pressure on the substance to be dispensed.

In the first embodiment shown in FIGS. 1 to 3, the dispenser is made up of three component parts, namely a semi-rigid shell 11, that is preferably thermoformed, a flat closure film 12 connected to the shell 11, and a piece of porous material 19 secured between the shell and the film 12. The film may be in the form of a flexible substrate or of a rigid substrate.

Figure 2A:
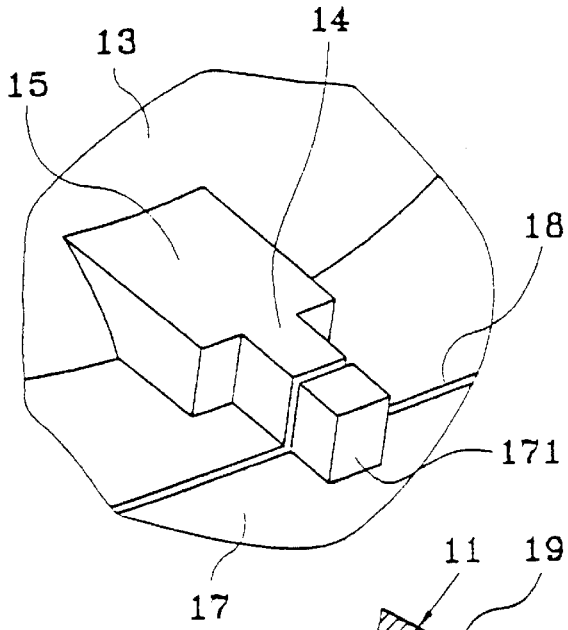
FIG. 2*a* is view on a larger scale of the detail circled with a dashed line in FIG. 1*a* and showing that portion of the dispenser which incorporates the spray orifice in the not-yet-used state.
Figure 2B:
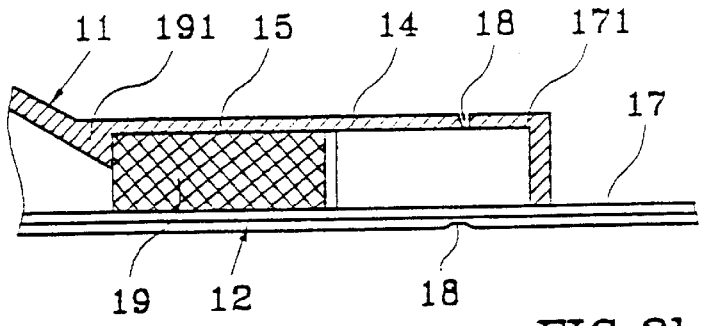
FIG. 2*b* is a cross-section view through the portion shown in FIG. 2*a;*

The semi-rigid shell 11 may be made from a sheet of thermoformable plastic. The flat sheet of plastic is deposited in a concave mold cavity to define a concave dome 13 and a channel 15 defining a recess terminating in a duct 14 made blind by a stopper portion 171 as shown in FIGS. 2*a* and 2*b*. Once it has been turned over, the shell defines a dome 13 connected to the recess 15 terminated by the channel 14, as can be seen in the various figures. Relative to the plane of the shell 11, the dome 13 defines a volume which corresponds to the volume of the reservoir which is also designated in the description below by the numerical reference 13.

Figures 1A, 1B, 1C, 1D:
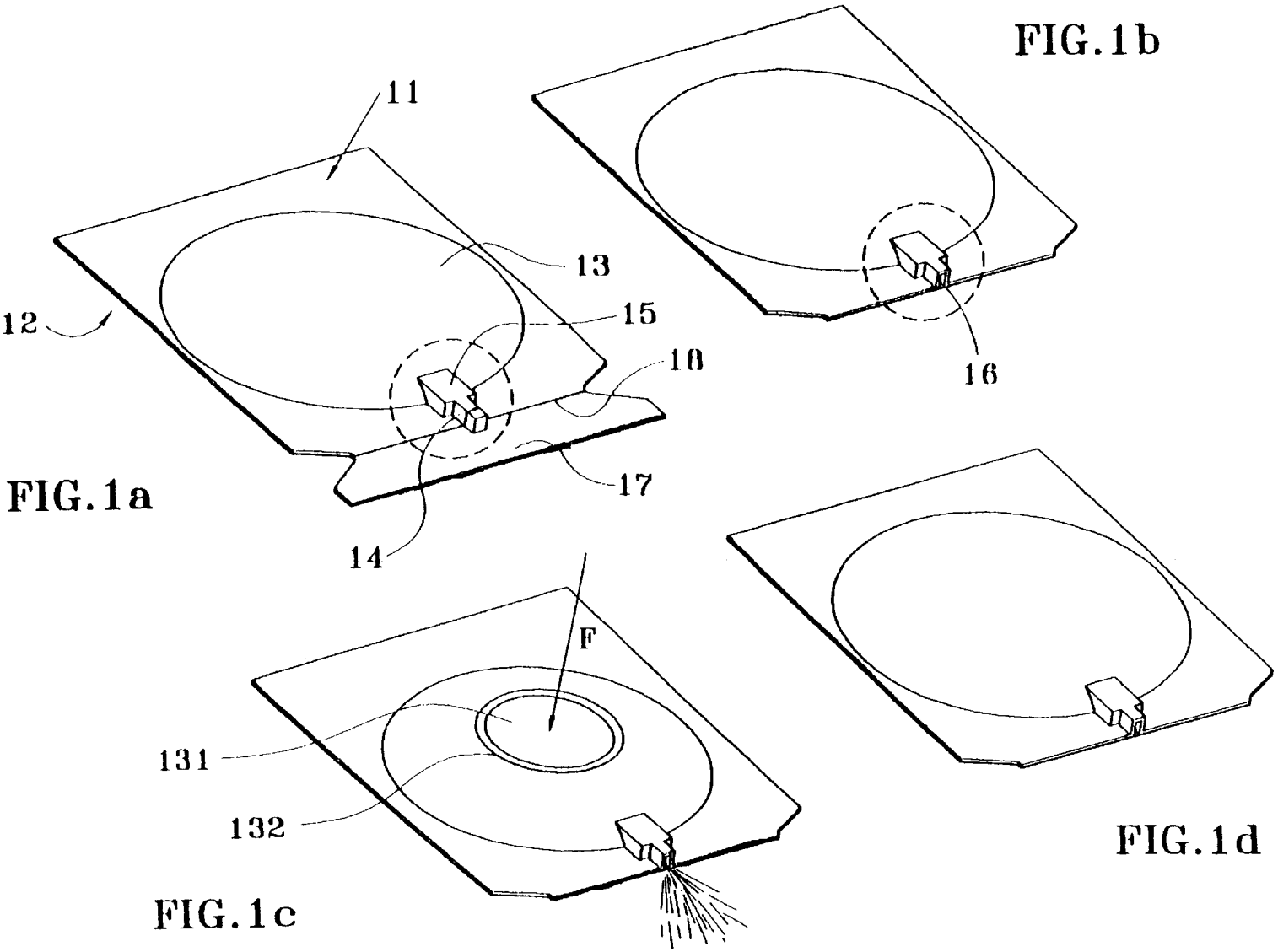
FIGS. 1*a* to 1*d* are diagrammatic perspective views of a dispenser device of the invention during various steps of use.

In order to complete the reservoir 13 formed by the dome of the shell 11, the closure film 12 is heat-sealed to the base of the shell 11 so as to isolate the reservoir 13, the recess 15, and the blind channel 14 from the outside, as can be seen in FIG. 1*a*, the shell and the closure film 12 therefore co-operating to define an internal volume constituted by the reservoir 13, by the recess 15, and by the blind channel 14.

Naturally, the fluid substance to be dispensed must be inserted into the reservoir 13 before it is closed by means of the film 12. Preferably, the quantity of fluid substance in each reservoir 13 is less than the total capacity of the reservoir 13 so that a portion of the reservoir 13 remains filled with a gas, e.g. air. Two-phase dispensing is thus achieved.

The fluid substance, and optionally the gas enclosed inside the shell 11 after closure, is totally isolated from the outside and cannot escape from said shell. In an embodiment, the shell 11 and the closure film 12 are provided with a common line of weakness 18 which passes across the blind duct 14. That portion of the shell 17 which is formed on the other side of the line of weakness 18 from the reservoir 13 defines a fold-back or tear-off tab serving as a stopper member. By folding back the tab 17, the portion 171 is detached from the duct 14 along the line of weakness 18. The duct 14 is then no longer blind, but rather it defines an orifice 16 serving as a spray orifice for the dispenser. Thus, once the detachable tab 17 has been torn off, the reservoir 13 can communicate with the outside via the channel 14 which is open via its spray orifice 16. Upstream from the channel 14, the recess 15 may, for example, enclose a spray nozzle of any type, but preferably, in the invention, the recess 15 contains a piece of porous material 19 which is explained in detail with reference to FIGS. 2 and 3. In any event, the recesss 15 may contain any means enabling the substance stored inside the reservoir 13 to be sprayed.

Once the tab 17 has been folded back, it is possible to dispense a metered quantity of fluid substance contained in the reservoir 13 by acting on the dome formed by the shell 11.

Naturally, the user understands that it is necessary to act on the top of the dome of the reservoir 13. At this place, the dome of the reservoir 13 defines an actuating wall 131 against which it is possible to act by means of the thumb, for example.

This actuating wall 131 has a convex profile at rest, which rest profile is incorporated into the dome of the reservoir 13 almost imperceptibly to the eye. The actuating wall 131 may be defined around its periphery by one or more grooves or ribs 132 which are formed inside the dome during the thermoforming. The grooves or ribs 132 thus serve firstly to define the zone of the actuating wall, and secondly to reinforce and stiffen its periphery. The grooves or ribs 132 reinforce the resistance of the concave profile to the deformation exerted in the direction indicated by arrow F in FIG. 1*c*. This resistance to deformation can also come from the special shape of the dome. Therefore, at the beginning of the pressing against the actuating wall 131, said wall is not subjected to any deformation, and the dome remains substantially intact. However, as the pressing force exerted on the actuating wall 131 exceeds a certain resistance threshold which depends on the geometrical shape, on the type, and on the thickness of the dome, as well as on the configuration and the layout of the grooves or ribs, the convex actuating wall 131 is suddenly deformed towards the inside of the reservoir until it reaches a final deformed position in which is forms a substantially concave profile corresponding to the convex profile of the initial state. It should be noted that the remainder of the dome constituting the reservoir 13 is not subjected to any deformation during the deformation of the actuating wall 131. Therefore, the variation caused by depressing the wall 131 towards the inside of the reservoir 13 generates a reduction in volume that is always constant because the initial state and the final state of deformation are constant. It is thus guaranteed that an identical quantity of air is expelled each time from the spray orifice 16. In addition, because it is necessary to go beyond this predetermined resistance-to-deformation threshold, the air pressurization state is guaranteed to be substantially identical each time the dispenser is actuated.

Finally, in order to make it possible to return to the initial rest position, the actuating wall has shape memory that results in an intrinsic return force urging the actuating wall 131 back from its pushed-in position to its convex rest position.

It should be understood that the concept of a predetermined resistance-to-deformation threshold does not mean that it is necessary to reach a predetermined minimum pressing force level beyond which any subsequent increase in the force makes it possible to deform the actuating wall 131 gradually. On the contrary, once the deformation of the actuating wall 131 has been initiated, the force necessary for subsequently deforming it to its fully pushed-in state is significantly lower than the force necessary for the initial deformation. In other words, the energy necessary to deform it completely after initial deformation is considerably less than the energy necessary for the initial deformation. By means of the predetermined threshold for the resistance to deformation of the wall 13, a force that is more than sufficient is available to enable the wall to be completely deformed subsequently. The resistance threshold acts in the manner of a collapse threshold beyond which the force necessary for deformation is much lower. And since the finger of the user accumulates considerable energy that must be greater than the predetermined threshold, it is guaranteed that the actuating wall 131 is depressed rapidly or even instantaneously towards its fully pushed-in position.

An actuating wall 131 as described above performs three advantageous functions, namely:

providing initial energy accumulation, thereby guaranteeing instantaneous actuation;

keeping the state of deformation of the wall constant; and returning the wall to its initial position.

On the basis of these considerations, it is possible to provide a dispenser that incorporates one or more of these functions.

Figure 3A:
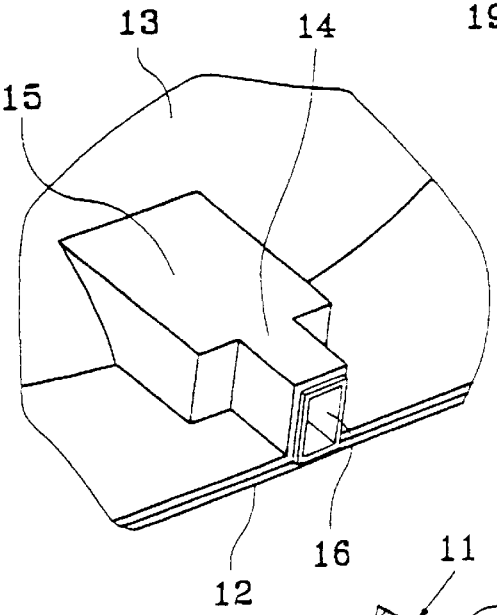
FIG. 3*a* is a view on a larger scale of the detail circled with a dashed line in FIG. 1*b* and showing the spray orifice in the in-use state.
Figure 3B:
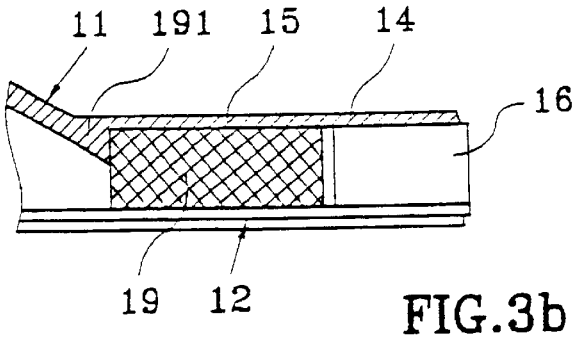
FIG. 3*b* is a cross-section view through the portion shown in FIG. 3*a*.
Figure 5A:
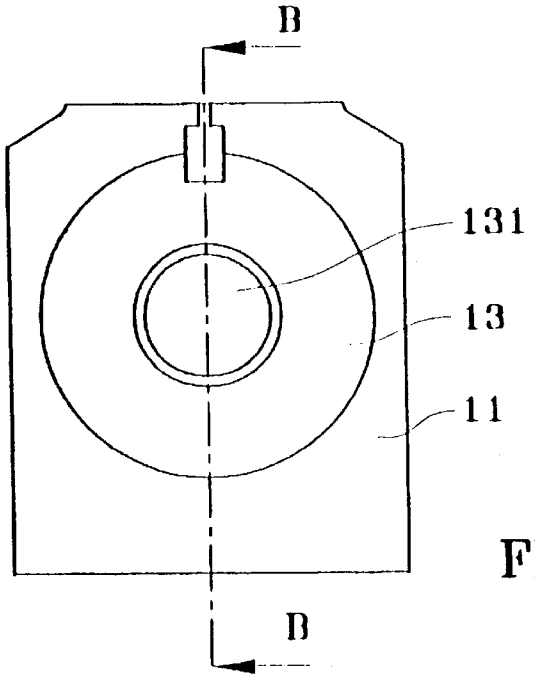
FIGS. 4*a* & 4*b* and 5*a* & 5*b* are cross-section views through a second embodiment of a dispenser device of the invention.
Figure 5B:
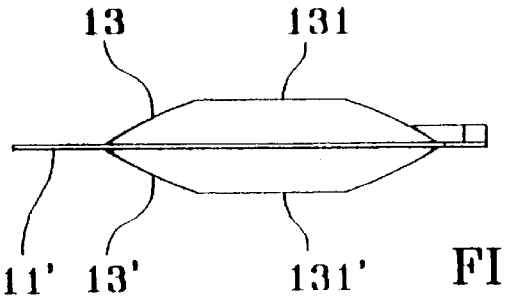
Figure 4A:
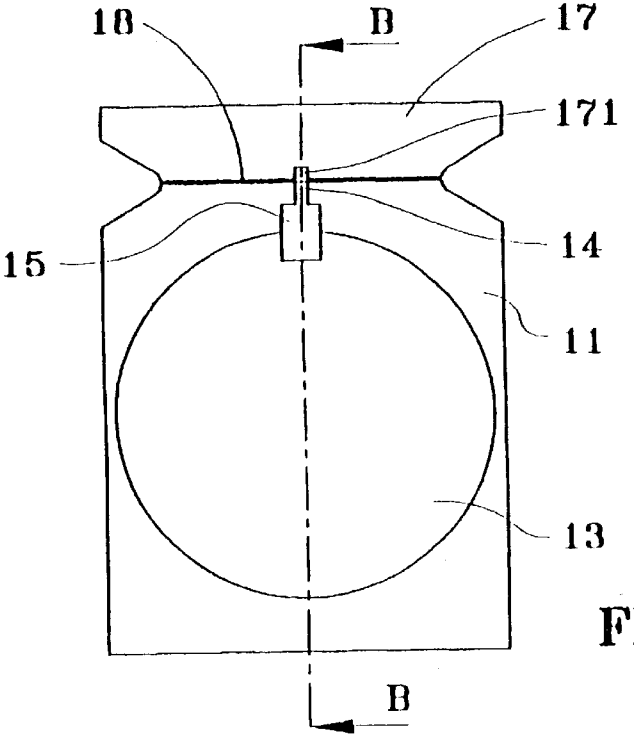
Figure 4B:
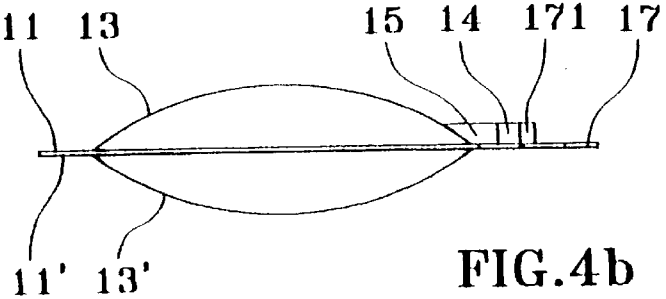

Reference is made below more particularly to FIGS. 2*b* and 3*b* to describe a particular embodiment using a piece of porous material 19 to perform the spraying through the orifice 16. The piece of porous material may be in the form of a small rectangular block and it is placed in the recess 15 formed by the shell 11 upstream from the outlet channel 14. The piece of porous material 19 is locked in the recess 15 at its downstream end by the wall sections adjoining the channel 14, and at its upstream end by a locking angle portion 191 formed by the shell 11. Therefore, the piece of porous material 19 cannot move, but it nevertheless remains in communication with the reservoir 13 so that it can be soaked by capillary action with the substance contained in the reservoir 13. While the dispenser is still sealed, as shown in FIGS. 2*a* and 2*b*, the channel 14 is closed off by the wall 171 which is part of the fold-back or detachable tab 17. While the dispenser is thus still sealed, the piece of porous material may nevertheless be soaked with substance while preventing the substance from going beyond said piece into the space formed by the duct 14. The capillary action that is generated by the piece of porous material prevents any substance from passing into said space. After the tab has been torn off, the duct 14 forms the spray orifice as shown in FIGS. 3*a* and 3*b*. Actuating the wall 131 then causes the air to be compressed and to be expelled through the piece of porous material soaked with substance, thereby causing it to be sprayed in two-phase manner through the orifice 16.

In an embodiment, the piece of porous material may be of size suitable for containing only a single metered quantity or "dose". After actuation, the piece of porous material 19 is then empty of its fluid substance. The piece of porous material 19 can then be re-charged merely by shaking the dispenser or by allowing it to stand horizontally on its closure film 12. After a few seconds, the piece of porous material 19 is once again completely soaked with fluid substance, and it is once again possible to actuate the dispenser. The piece of porous material 19 thus acts in the manner of a metering chamber which guarantees that the quantity of substance dispensed remains constant.

In a variant embodiment, while occupying the recess 15, the piece of porous material 19 may extend into the reservoir in the manner of a plunger tube. In which case, the porous piece may retain a plurality of metered quantities so that it is possible to actuate the dispenser a plurality of times consecutively.

In addition, this piece acts as a stopper which prevents the substance from leaking out through the orifice 16. Therefore, even when the dispenser is open, i.e. with its tab 17 torn off, it is easy to transport the dispenser even upside down without any risk of leakage.

FIGS. 4*a* & 4*b* and 5*a* & 5*b* show a second embodiment, in which the rigid or flexible closure film may be replaced with another thermoformed shell 11' similar to the shell in the first embodiment. The dispenser is then almost totally symmetrical except for the recess for the porous piece and the outlet orifice, said recess and said orifice being formed in one of the shells only. In this variant, the deformation volume is doubled, and thus the quantity of dispensed substance is doubled, because there is an actuating wall on each shell. Another inherent advantage of this double-sided dispenser lies in its resistance to compression because each of its faces is provided with an actuating wall of the invention having a resistance-to-deformation threshold. This characteristic is particularly sought-after for uses as a free sample inserted in a magazine.

By combining simultaneously in the same dispenser the advantages of the actuating wall of the invention and of a piece of porous material placed upstream from the spray orifice, it is guaranteed firstly that the metered quantity of substance distributed is constant and accurate, and secondly that the pressure and the quantity of air expelled through the piece of porous material are constant and accurate. It is thus possible to guarantee optimum spray quality for a single sample of perfume, for example.

What is claimed is:

1. A dispenser device for dispensing a fluid substance in spray form comprising:

a reservoir containing the fluid substance to be dispensed, and a spray duct that is initially sealed closed with a seal portion and that is subsequently opened by pulling said seal portion away from said spray duct to define an open spray orifice across said spray duct, said reservoir including at least one actuating wall that can be deformed by a user applying a pressing force to reduce the internal volume of the reservoir after said spray duct has been opened and thus to exert a pressure on the fluid substance to deliver it through the spray orifice wherein said at least one actuating wall has a predetermined threshold of resistance to deformation after said spray duct has been opened that must be overcome in order to deform it and wherein the resistance to deformation of said at least one actuating wall falls below said predetermined threshold after initial application to said at least one actuating wall of a pressing force that is initially greater than said predetermined threshold, said at least one actuating wall being constructed to prevent deformation sufficient to open said initially sealed closed spray duct when a pressing force is applied by said user.

2. The dispenser device of claim 1 wherein said at least one actuating wall has shape memory enabling it to return to its initial shape after said pressing force is released.

3. The dispenser device of claim 1 wherein said at least one actuating wall has a constant deformed state so that the quantity of product dispensed is constant and metered.

4. The dispenser device of claim 1 wherein said at least one actuating wall has a convex profile at rest, which rest profile is suitable for deforming suddenly and easily into a determined concave profile when a pressing force is applied to said wall and the pressing force reaches said threshold of resistance.

5. The dispenser device of claim 1 wherein said at least one actuating wall has at least one reinforcing rib or groove for increasing its rigidity or defining its periphery.

6. The dispenser device of claim 1 wherein said reservoir contains both a fluid substance and a gas to obtain a two-phase spray of fluid substance and of gas at said spray orifice.

7. The dispenser device of claim 6, further comprising an insert having a retaining piece of porous material suitable for soaking with fluid substance disposed upstream from said spray orifice.

8. The dispenser device of claim 1 wherein said spray orifice is hermetically sealed off by a stopper member before said dispenser device is used.

9. The dispenser device of claim 1 made of a thermoformed shell forming said actuating wall and of a closure film, said shell and said film co-operating to define said reservoir and said spray orifice.

10. The dispenser device of claim 1 made of two thermoformed shells each of which forms an actuating wall, the two shells being assembled together in sealed manner to form said reservoir and said spray orifice between them.

* * * * *